US005377593A

United States Patent [19]

Boothe et al.

[11] Patent Number: 5,377,593

[45] Date of Patent: Jan. 3, 1995

[54] INTERPENETRATING NETWORK COMBINATION OF ULTRAVIOLET AND THERMALLY CURED ROCKET MOTOR LINER COMPOSITION AND METHOD

[75] Inventors: Richard E. Boothe, Madison; Dale E. Hutchens, Huntsville, both of Ala.

[73] Assignee: Thiokol Corporation, Ogden, Utah

[21] Appl. No.: 838,091

[22] Filed: Feb. 20, 1992

[51] Int. Cl.[6] ..... C06B 45/00; C06D 5/06

[52] U.S. Cl. ..... 102/289; 102/290; 102/291

[58] Field of Search ..... 102/290, 289, 291

[56] References Cited

U.S. PATENT DOCUMENTS

| | | | |
|---|---|---|---|
| H523 | 9/1988 | Braun | 102/290 X |
| 4,601,862 | 7/1986 | Byrd et al. | 264/3.1 |
| 4,803,019 | 2/1989 | Graham et al. | 264/3.1 |
| 5,031,539 | 7/1991 | Hutchens | 102/290 |

*Primary Examiner*—Peter A. Nelson

*Attorney, Agent, or Firm*—Madson & Metcalf; Ronald L. Lyons

[57] ABSTRACT

An interpenetrating network combination of ultraviolet and thermally curable rocket motor liner formulation comprising an optional solid filler, at least one ultraviolet curable polymer, an optional ultraviolet reactive diluent, at least one thermally curable polymer and at least one curing agent.

8 Claims, No Drawings

INTERPENETRATING NETWORK COMBINATION OF ULTRAVIOLET AND THERMALLY CURED ROCKET MOTOR LINER COMPOSITION AND METHOD

BACKGROUND OF THE INVENTION

This invention relates to an interpenetrating network combination of ultraviolet and thermally cured rocket motor liner composition and method.

The following patents are directed to rocket motor liners: U.S. Pat. Nos. 5,031,539, 4,803,019, 4,736,684 and 4,663,196 all of which are hereby incorporated by reference, in toto. All are useful background information.

SUMMARY OF THE INVENTION

This invention is an interpenetrating network combination of ultraviolet and thermally curable rocket motor liner formulations comprising an optional solid filler, at least one ultraviolet curable polymer, an optional ultraviolet reactive diluent, at least one thermally curable polymer and at least one curing agent. Preferably the filler is present in an amount of between about 0 and about 50% by weight, the ultraviolet curable polymer is present in an amount of between about 4 and about 80% by weight, the ultraviolet reactive diluent is present in an amount of between about 0 and about 30% by weight, the thermally curable polymer is present in an amount of between about 2 and about 30% by weight and the curing agent is present in an effective amount. The preferable filler does not absorb ultra-violet radiations, and can be selected for silica, calcium carbonate and dicyandiamide. The preferred ultraviolet curable polymer is selected from the group consisting of a saturated hydrocarbon diacrylate and an acrylated polybutadiene or both. The ultraviolent reactive diluent is preferably isooctyl acrylate. The preferred thermally curable polymer is a polybutadiene prepolymer. The preferred curing agent is a of dimer diisocyanate. It is also preferred to use a free-radical photoinitiator, such as hydroxy isobutyrophenone. An even more preferred formulation of this invention contains dicyandiamide in an amount of about 24% by weight, saturated hydrocarbon diacrylate in an amount of about 18.5% by weight, acrylated polybutadiene in an amount of about 18.5% by weight, isooctyl acrylate diluent in an amount of about 18.5% by weight, the dimer diisocyanate in an amount of about 3.7% by weight and the hydroxy isobutyrophenone present in an amount of about 0.8% by weight.

The method of this invention is a method of lining a rocket motor casing intended to contain a propellant having a binder comprising coating the rocket motor casing with the ingredients of the above formulations, precuring the ultraviolet curable polymer, casting the propellant in said casing and co-currently curing the thermally curable polymer and the propellant. Preferably the binder of the propellant binder is polybutadiene and more preferably a hydroxyl terminated polybutadiene.

PREFERRED EMBODIMENTS OF THE INVENTION

This formulation is for a combination UV/thermally cured liner that is precured within minutes to a state which allows propellant casting, exhibits good mechanical properties and good adhesion to HTPB propellant and steel. The formulation is shown below:

| Ingredient | Description | % |
|---|---|---|
| Dicyandiamide | Solid Filler | 24.0 |
| SR-5000 | UV Curable Polymer[1] | 18.5 |
| SR-440 | UV Reactive Diluent[1] | 18.5 |
| ZL-1365 | UV Curable Polymer[2] | 18.5 |
| R45M | Thermally Curable Polymer | 16.0[3] |
| Dimer Diisocyanate | Isocyanate Curative | 3.7[3] |
| Hydroxy Isobutyrophenone | Free Radical Cure Initiator | 0.8 |
| | | 100.0 |

[1]Sartomer Company, West Chester, PA 19382
[2]Morton International, Chicago, IL 60606
[3]Varies depending upon equivalent weight The formulation is quickly and inexpensively precured with UV radiation to a state acceptable for casting of propellant onto it (the SR-5000, SR-440 and ZL-1365 crosslink during UV exposure), then fully cured upon exposure to heat during propellant cure (the R45M and DDI react to form urethane crosslinks). An interpenetrating network of polyurethane and polyacrylic crosslinks is formed. After UV precure, free —OH and —NCO on the surface of the liner are available to react with propellant binder and curative, which aids adhesion of the liner to propellant.

DEFINITION OF INGREDIENTS AND TERMS

SR-5000 is acrylated polybutadiene
SR-440 is isooctyl acrylate
ZL-1365 is a saturated hydrocarbon diacrylate polymer.
R45M is a polybutadiene polymer.
"HTPB" means hydroxyl terminated polybutadiene polymer.
R45HT is a hydroxyl terminated polybutadiene polymer.
"UV" means ultraviolet.
CL-205 is an anticorrosion primer, metal to rubber adhesive (Chemlock)
CL-234B is a metal to rubber adhesive (Chemlock)
"pli" means pounds per linear inch.
DDI is dimer diisocyanate.
DCDA is dicyandiamide.
HIBP is hydroxy isobutyrophenone.

| Test Abbreviations | |
|---|---|
| BL/P | Bond-Liner to Propellant |
| BL/I | Bond-Liner to Insulation |
| BL/M | Bond-Liner to Metal |
| P | Propellant Failure |
| L | Liner Failure |
| BL/A | Bond-Liner to Adhesive |
| TCP/L | Thin Coat of Propellant at Liner Interface |
| TCP/A | Thin Coat of Propellant at Adhesive Interface |

Results of peel adhesion tests to HTPB propellant and steel were based on Sample d) and are as follows:

Peel Adhesion to HTPB Propellant=11 pli
Failure Mode=2–10% P, 0–2% L, 90–98% BL/A
Peel Adhesion to Steel Treated With CL-205/CL-234B=15 pli
Failure Mode=10–25% UV, 75–90% BA/UV
The mechanical properties are as follows:

| Test Temperature (°F.) | Ult. Stress (psi) | Ult. Strain (%) |
|---|---|---|
| −65 | 732[4] | 36[4] |
| 77 | 170[4] | 41[4] |

-continued

| Test Temperature (°F.) | Ult. Stress (psi) | Ult. Strain (%) |
|---|---|---|
| −65 | 1471[5] | 14[5] |
| 77 | 135[5] | 46[5] |

[4]After UV precure, no thermal cure
[5]After UV and thermal cure

The combination UV/thermal cure approach can be extended to any combination of thermally cured and UV cured materials. Other materials are listed in the prior art patents incorporated by reference above. See particularly U.S. Pat. No. 4,803,019 and 5,031,539.

Possible alternatives to this formulation include increasing the relative percentage of thermally cured materials, which would likely improve the mechanical properties and adhesion to HTPB propellants. R45-HT could be substituted for R45M, which would reduce the cost of the formulation.

This approach might also be applicable for use as a "quick setting" adhesive, which could be partially cured instantaneously to a semi-rigid state, then fully cured upon application of heat or standing at ambient temperature for a period of time.

PEEL TESTING

Following are peel tests on samples from variations of the above formulation shown below with variations as noted with each test result.

| | | | | | | | | |
|---|---|---|---|---|---|---|---|---|
| a) | 49% SR-5000 | 40% | b) | 49% SR-5000 | 95% | c) | 49% SR-5000 | 80% |
| | 24.5% ZL-1365 | | | 24.5% ZL-1365 | | | 24.5% ZL-1365 | |
| | 24.5% SR-440 | | | 24.5% SR-440 | | | 24.5 SR-440 | |
| | 2.0% HIBP | | | 2.0% HIBP | | | 2.0% HIBP | |
| | HTPB/DDI | 60% | | HTPB | 5% | | HTPB | 20% |
| | Label: 49% SR-5000 | | | Label: 49% SR-5000 | | | Label: 49% SR-5000 | |
| | 60% HTPB/DDI | | | 5% HTPB | | | 20% HTPB | |
| d) | 30% DCDA | | e) | 30% DCDA | | f) | 30% DCDA | |
| | 23% SR-5000 | 80% | | 23% SR-5000 | 50% | | 23 SR-5000 | 95% |
| | 23% SR-440 | | | 23% SR-440 | | | 23 SR-400 | |
| | 23% ZL-1365 | | | 23% ZL-1365 | | | 23 ZL-1365 | |
| | 1.0% HIBP | | | 1.0% HIBP | | | 1.0% HIBP | |
| | HTPB/DDI | 20% | | HTPB/DDI | 50% | | HTPB/DDI | 5% |
| | Label: 30% DCDA | | | Label: 30% DCDA | | | Label: 30% DCDA | |
| | 20% HTPB/DDI | | | 50% HTPB/DDI | | | 5% HTPB | |

| | Avg. Peel (lbs/in) | Failure Mode and Remarks |
|---|---|---|
| Sample a) | | |
| 49% SR-5000 | 5.0 | 5% uncured area, 95% BL/A |
| 60% HTPB/DDI | 5.1 | 3% uncured area, 97% BL/A |
| | 5.5 | BL/A |
| Avg. | 5.2 | |
| Sample b) | | |
| 49% SR-5000 | 9.5 | 3% uncured area, 50% L, 46% BL/A |
| 5% HTPB | 10.0 | 50% L, 50% BL/A (AB) |
| | 9.0 | 14% void, 43% L, 43% BL/A |
| Avg. | 9.5 | |
| Sample c) | | |
| 49% SR5000 | 8.5 | 2% P, 98% BL/A |
| 20% HTPB | 7.5 | 7% uncured area, 93% BL/A |
| | — | Sample no good |
| Avg. | 8.0 | |
| Sample d) | | |
| 30% DCDA | 12.3 | 5% uncured area, 10% P, 85% BL/A |
| 20% HTPB/DD | 8.5 | 5% uncured area, 2% L, 93% BL/A |
| | 12.2 | 2% uncured area, 3% P, 2% L, 93% BL/A |
| Avg. | 11.0 | |

VARIOUS ADHESIVE, PRIMER COMBINATIONS

These tests were for adhesion to steel with formulation sample d).

| | | |
|---|---|---|
| 205/234B | 15.5 | 75% BA/UV, 25% UV |
| Heat before | 16.0 | 15% UV, 85% BA/UV |
| UV | 13.6 | 90% BL/UV, 10% UV |
| Avg. | 15.0 | |
| 205/234B | 12.0 | 60% BA/UV, 25% UV, 15% TCUV/A |
| 2 hrs @ 225 | 12.5 | 80% TCUV/A, 15% RA/UV, 5% UV |
| F + P | | |
| | 15.0 | 10% BH/205, 90% TCUV/Liner |
| Avg. | 13.2 | |
| 205/238 | 6.0 | 15% BA/UV, 85% TCUV/Chemlok |
| | 2.5 | TCUV/Chemlok |
| | 4.5 | 8% BA/UV, 92% TCUV/Chemlok |
| Avg. | 4.3 | |
| 205 | 1.8 | 60% TCUV/Chemlok, 40% BUV/Chemlok |
| | 2.5 | 90% TCUV/Chemlok, 10% BUV/Chemlok |
| | 2.3 | 90% TCUV/Chemlok, 10% BUV/Chemlok |
| Avg. | 2.2 | |

LINER TENSILE TESTING

Following are tensile testing on the Sample d).

| Thickness $T_1$ | Thickness $T_2$ | Thickness $T_3$ | Ult. Stress psi | Ult. Strain % | Thickness Avg. | Remarks |
|---|---|---|---|---|---|---|
| Mix No.: UV Precured, No Thermal Cure | | | | | | |

-continued

| Thickness $T_1$ | Thickness $T_2$ | Thickness $T_3$ | Ult. Stress psi | Ult. Strain % | Thickness Avg. | Remarks |
|---|---|---|---|---|---|---|
| | | Crosshead Speed: 20.0/mins | | | | |
| .0190 | .0200 | .0192 | 157.6 | 39.4 | .0194 | 77° F. |
| .0132 | .0162 | .0179 | 182.2 | 43.0 | .0158 | 77° F. |
| | | Avg | 169.9 | 41.2 | | |
| .0258 | .0290 | .0248 | 650.4 | 26.9 | .0265 | −65° F. |
| .0280 | .0270 | .0272 | 759.6 | 43.2 | .0274 | −65° F. |
| .0238 | .0242 | .0272 | 786.0 | 37.9 | .0251 | −65° F. |
| | | Avg | 732.0 | 36.0 | | |
| | | Mix No.: UV Precure Plus Thermal Cure | | | | |
| | | Crosshead Speed: 20.0/mins | | | | |
| | | Test Temperature: −65° | | | | |
| .0152 | .0152 | .0136 | 1581 | 8.2 | | |
| .0165 | .0141 | .0172 | 1545 | 22.3 | | |
| .0140 | .0141 | .0189 | 1287 | 10.1 | | |
| | | Avg | 1471 | 13.5 | | |
| | | Mix No.: UV Precure Plus Thermal Cure | | | | |
| | | Crosshead Speed: 20.0/mins | | | | |
| | | Test Temperature: 77° | | | | |
| .0210 | .0190 | .0162 | 144 | 53.0 | | |
| .0159 | .0220 | .0182 | 143 | 43.3 | | |
| .0255 | .0250 | .0312 | 119 | 42.9 | | |
| | | Avg | 135 | 46.4 | | |

We claim:

1. An interpenetrating network combination of ultraviolet and thermally curable rocket motor liner formulation comprising at least one ultraviolet curable polymer, at least one thermally curable polymer and at least one curing agent.

2. The formulation of claim 1 wherein said formulation also contains a solid filler and an ultraviolet reactive diluent.

3. The formulation of claim 2 wherein said filler is present in an amount of between about 0 and about 50% by weight, said ultraviolet curable polymer is present in an amount of between about 4 and about 80% by weight, said ultraviolet reactive diluent is present in an amount of between about 0 and about 30% by weight said thermally curable polymer is present in an amount of between about 2 and about 30% by weight and said curing agent is present in an effective amount.

4. The formulation of claim 3 wherein said filler is selected from the group consisting of silica, calcium carbonate and dicyandiamide, said ultraviolet curable polymer is selected from the group consisting of a saturated hydrocarbon diacrylate and acrylated polybutadiene or both, said thermally curable polymer is a polybutadiene, said ultraviolet reactive diluent is isooctyl acrylate, said curing agent is dimer diisocyanate and used with the free-radical photoinitiator, hydroxy isobutyrophenone.

5. The formulation of claim 4 wherein said dicyandiamide is present in an amount of about 24% by weight, said saturated hydrocarbon diacrylate is present in an amount of about 18.5% by weight, said acrylated polybutadiene is present in an amount of about 18.5% by weight, said isooctyl acrylate is present in an amount of about 18.5% by weight, said dimer diisocyanate is present in an amount of about 3.7% by weight and said hydroxy isobutyrophenone is present in an amount of about 0.8% by weight.

6. The method of lining a rocket motor casing intended to contain a propellant having a binder comprising coating said rocket motor casing with the formulation of any one of claims 1 to 5, precuring said ultraviolet curable polymer, casting said propellant in said casing and co-currently curing said thermally curable polymer and said propellant.

7. The method of claim 6 wherein said propellant binder is polybutadiene.

8. The method of claim 7 wherein said propellant binder is hydroxyl terminated polybutadiene.

* * * * *